US008957756B2

(12) United States Patent
Belman et al.

(10) Patent No.: US 8,957,756 B2
(45) Date of Patent: Feb. 17, 2015

(54) SULFURATION RESISTANT CHIP RESISTOR AND METHOD FOR MAKING SAME

(71) Applicant: Vishay Intertechnology, Inc., Malvern, PA (US)

(72) Inventors: Michael Belman, Beer-Sheva (IL); Leonid Akhtman, Shani (IL)

(73) Assignee: Vishay Intertechnology, Inc., Malvern, PA (US)

( * ) Notice: Subject to any disclaimer, the term of this patent is extended or adjusted under 35 U.S.C. 154(b) by 0 days.

(21) Appl. No.: 13/970,011

(22) Filed: Aug. 19, 2013

(65) Prior Publication Data

US 2013/0335191 A1 Dec. 19, 2013

Related U.S. Application Data

(63) Continuation of application No. 13/185,065, filed on Jul. 18, 2011, now Pat. No. 8,514,051, which is a continuation of application No. 12/030,281, filed on Feb. 13, 2008, now Pat. No. 7,982,582.

(60) Provisional application No. 60/892,503, filed on Mar. 1, 2007.

(51) Int. Cl.

| | |
|---|---|
| ***H01C 1/012*** | (2006.01) |
| ***H01C 1/034*** | (2006.01) |
| ***H01C 17/28*** | (2006.01) |

(52) U.S. Cl.

CPC ..... *H01C 1/034* (2013.01); *H01C 17/288* (2013.01)

USPC ..... 338/307; 338/309

(58) Field of Classification Search

USPC ..... 338/307–309

See application file for complete search history.

(56) References Cited

U.S. PATENT DOCUMENTS

| | | | |
|---|---|---|---|
| 5,966,067 | A | 10/1999 | Murakami et al. |
| 6,153,256 | A | 11/2000 | Kambara et al. |

(Continued)

FOREIGN PATENT DOCUMENTS

| | | | |
|---|---|---|---|
| CN | 1245340 | A | 2/2000 |
| EP | 1271566 | A2 | 1/2003 |

(Continued)

OTHER PUBLICATIONS

WO2006030705, Kinoshita et al., Mar. 23, 2006, machine translation.*

(Continued)

*Primary Examiner* — Kyung Lee

(74) *Attorney, Agent, or Firm* — Volpe and Koenig, P.C.

(57) ABSTRACT

A chip resistor includes an insulating substrate, top terminal electrodes formed on top surface of the substrate using silver-based cermet, bottom electrodes, resistive element that is situated between the top terminal electrodes and overlaps them partially, an optional internal protective coating that covers resistive element completely or partially, an external protective coating that covers completely the internal protection coating and partially covers top terminal electrodes, a plated layer of nickel that covers face sides of the substrate, top and bottom electrodes, and overlaps partially external protective coating, finishing plated layer that covers nickel layer. The overlap of nickel layer and external protective layer possesses a sealing property because of metallization of the edges of external protective layer prior to the nickel plating process.

11 Claims, 4 Drawing Sheets

(56) References Cited

U.S. PATENT DOCUMENTS

| | | | | |
|---|---|---|---|---|
| 6,201,290 | B1 | 3/2001 | Yamada et al. | |
| 6,242,999 | B1 | 6/2001 | Nakayama et al. | |
| 6,943,662 | B2 | 9/2005 | Tanimura | |
| 7,098,768 | B2 | 8/2006 | Doi | |
| 7,782,173 | B2 | 8/2010 | Urano et al. | |
| 7,982,582 | B2 * | 7/2011 | Belman et al. | 338/307 |
| 8,514,051 | B2 * | 8/2013 | Belman et al. | 338/307 |
| 2002/0031860 | A1 | 3/2002 | Tanimura | |
| 2002/0148106 | A1 | 10/2002 | Tsukada et al. | |
| 2003/0117258 | A1 | 6/2003 | Kim et al. | |
| 2004/0262712 | A1 | 12/2004 | Doi | |
| 2008/0094169 | A1 | 4/2008 | Kinoshita et al. | |
| 2012/0126934 | A1 | 5/2012 | Belman et al. | |

FOREIGN PATENT DOCUMENTS

| | | | |
|---|---|---|---|
| JP | 08203713 | A | 8/1996 |
| JP | 2000-299203 | A | 10/2000 |
| JP | 2001-023801 | A | 1/2001 |
| JP | 2001-110601 | A | 4/2001 |
| JP | 2001-143905 | A | 5/2001 |
| JP | 2002-184602 | A | 6/2002 |
| JP | 2006-024767 | A | 1/2006 |
| TW | 434586 | B | 5/2001 |
| WO | 2006/030705 | A1 | 3/2006 |

OTHER PUBLICATIONS

Axtel, Steven C., et al., "Failure of Thick-Film Chip Resistors in Sulfur-Containing Environments" CARTS2002: 22nd Capacitor and Resistor Technology Symposium, Mar. 25-29, 2002 (pp. 89-94).

AAC (American Accurate Components, Inc.), Thick Film Resistors—Gold Terminal, Non Sulfuration, order form, Aug. 2005 (1 page).

Panasonic—New Products News—"Thick Film Chip Resistor, 1005 Anti-Sulfurated Thick Film Chip Resistor," Feb. 2004 (1 page).

Venkel Ltd., "Thick Film Chip Resistors—Anti-Sulfuration," order form, Dec. 2007 (1 page).

Search Report for co-pending PCT/US2008/054557 listing relevant art cited by the International Searching Authority, Feb. 21, 2008.

* cited by examiner

SULFURATION RESISTANT CHIP RESISTOR AND METHOD FOR MAKING SAME

CROSS REFERENCE TO RELATED APPLICATIONS

This application is a continuation of U.S. patent application Ser. No. 13/185,065, filed Jul. 18, 2011, issuing as U.S. Pat. No. 8,514,051 on Aug. 20, 2013, which is a continuation of U.S. patent application Ser. No. 12/030,281, filed Feb. 3, 2008, now U.S. Pat. No. 7,982,582, issued Jul. 19, 2011, which claims the benefit of U.S. Provisional Patent Application No. 60/892,503, filed Mar. 1, 2007, the entire contents of all of which are hereby incorporated by reference as if fully set forth herein.

BACKGROUND

The present invention relates to chip resistors, and in particular, chip resistors which are sulfuration resistant.

Terminal electrodes in a majority of thick-film chip resistors and in some thin-film resistors are made of silver-based cermets. Metallic silver has several advantageous properties, including high electrical conductivity and excellent immunity to oxidizing when silver based cermets are fired in the air. Unfortunately metallic silver also has its shortcomings. One such shortcoming is metallic silver's remarkable susceptibility to sulfur and sulfur compounds. At that, silver forms non-conductive silver sulfide resulting in open circuit in the silver-based resistor terminals. The described failure mechanism is called sulfuration phenomenon or sulfuration.

A prior art non-sulfur proof thick-film chip resistor is presented in FIG. 2. It consists of an isolative substrate 1, upper silver-based terminal electrodes 2, bottom silver-based electrodes 3, a resistive element 4, an optional protective layer 5, an external protective layer 6, plated nickel layer 7, and a plated finishing layer (commonly tin) 8. Each upper electrode 2 is covered by abutting layers: (a) external protective coating 6 (glass or polymer), and (b) plated nickel 7 and finishing 8 layers. The problem is that the non-metal coating 6 from one side, and plated metal layers 6, 7 from another side have a poor adhesion to each other. It promotes a small gap between them and results in ambient air penetration to the surface of silver electrodes 2. If the ambient air includes sulfur compounds, the silver electrodes will be destructed after a time. That is why commodity chip resistors often fail in automotive and industrial applications.

Two known ways to prevent the sulfuration phenomenon are used. One method involves replacing or cladding of silver by another noble metal that is sulfur proof (gold, silver-palladium alloy, etc.). A second method is to prevent the silver-based terminals from contact with ambient air (sealing of the terminals).

The disadvantages of the first method include the expensiveness of sulfur proof noble metals, the lower electrical conductivity of sulfur proof noble metals relative to metallic silver, as well as the possible incompatibility of non-silver terminals with thick-film resistor inks that are designed for use with silver termination.

The second method according to prior art (see, for example, U.S. Pat. No. 7,098,768, herein incorporated by reference in its entirety) consists of adding of two layers: auxiliary upper electrodes 9 (FIG. 3) and uppermost overcoat 6'. Auxiliary upper electrodes 9 cover completely each of upper silver-based terminal electrodes 2 and overlap partially the external protective coating 6. The uppermost overcoat 6' covers the middle portion of the resistor and overlaps auxiliary upper electrodes 9.

In such a configuration, the auxiliary upper electrodes should be both platable (conductive) and sulfur proof. Examples of such material include polymer-based thick-film inks with carbon filler or base metal filler and sintering-type thick-film inks with base metal filler. The disadvantages of using auxiliary upper electrodes include low electrical conductivity and poor platability of polymer-based materials with carbon or base metal filler, possible resistance shift when sintering type inks are used for auxiliary upper electrodes, problematic implementation in small size resistors (1 mm length and less) where it is difficult to keep positional relationship between multiple layers that overlap each other in the terminal, and increased resistor thickness.

What is needed is an improved chip resistor which is sulfuration resistant.

SUMMARY

It is, therefore, a principal object, feature, aspect, or advantage of the present invention to improve over the state of the art relative to addressing the sulfuration phenomenon with chip type of resistor.

Another object, feature, or advantage of the present invention is to provide for a chip resistor which is sulfuration resistant which does not require an additional protective layer which would increase thickness of the chip resistor beyond the thickness of a standard (non-sulfuration resistant) chip resistor.

Yet another object, feature, or advantage of the present invention is a configuration or design that is applicable to all sizes of chip resistors, including the smallest ones where, for example, introduction of an additional protective layer with secure overlaps with adjacent layers would be potentially problematic.

A still further object, feature, or advantage of the present invention is to provide a chip resistor which does not have the limitations associate with the additional protective layers found in the prior art, such as being (a) conductive, (b) non-silver, (c) suitable for deposition at low temperature. Materials that meet such requirements (for example polymer based carbon ink) have limited platability.

Thus, a still further object, feature, or advantage of the present invention is to provide a sulfuration resistant chip resistor with terminals having good platability.

Further objects, features, aspects, and advantages of the present invention will become more apparent with reference to the other parts of this application. One or more of these and/or other objects, features, aspects, or advantages of the present invention will become apparent from the specification and claims that follow.

According to one aspect of the present invention a chip resistor includes upper sulfuration-susceptible terminal electrodes on opposite sides of a resistive element mounted over an insulating substrate and an external non-conductive protective coating over the resistive element. There is at least one conducting metal plated layer covering opposite face sides of the insulating substrate and part of the top sulfuration-susceptible terminal electrodes, the metal plated layer being adhered to the sulfuration-susceptible terminal electrodes and adjacent edges of the external non-conductive protective coating by a pre-applied metal layer.

According to another aspect of the present invention, a method is provided for deterring sulfuration in a chip resistor having upper sulfuration-susceptible terminal electrodes on opposite sides of a resistive element mounted over an insulating substrate, an external non-conductive protective coating over the resistive element, and at least one conducting metal plated layer covering opposite face sides of the insulating substrate and part of the top sulfuration-susceptible terminal electrodes. The method provides for sealing the terminal electrodes from the external environment. The sealing may be performed by overlapping the metal plated layer over exposed top portions of the terminal electrodes and over adjacent edges of the external non-conductive protective coating or sealing the terminal electrodes comprises moralizing adjacent edges of the external non-conductive protective coating prior to application of the metal plated layer.

According to another aspect of the present invention, a chip resistor is formed by the process of forming top terminal electrodes and a resistive element on the top of an insulative substrate having face sides, forming a non-conducting external protective coating over the resistive element and adjacent portions of the top terminal electrodes, masking a middle portion of the external protective coating, metallizing edges of the external protective coating by sputtering, metallizing face sides of the substrate by sputtering or by conductive ink application, removing the mask, nickel plating the metallized edges of the external protective coating and face sides of the substrate, and placing a finishing layer over the nickel plating.

According to another aspect of the present invention, a chip resistor includes an insulating substrate having a top surface, an opposite bottom surface and opposing face surfaces, top terminal electrodes formed on the top surface of the substrate, bottom electrodes formed on the bottom surface of the substrate, a resistive element positioned between the top terminal electrodes and partially overlapping the top terminal electrodes, an external protective coating that partially covers the top terminal electrodes, wherein edges of the external protective coating being activated to facilitate coverage by plating, a plated layer of nickel covering the face surfaces of the substrate, the top and bottom electrodes, and overlapping the edges of the external protective coating thereby sealing the underlying top terminal electrodes from ambient atmosphere.

DETAILED DESCRIPTION OF THE PREFERRED EMBODIMENTS

For a better understanding of the invention, a specific apparatus and method of making same will now be described in detail. It is to be understood that this is but one form the invention can take. Variations obvious to those skilled in the art will be included within the invention.

Figure 1:
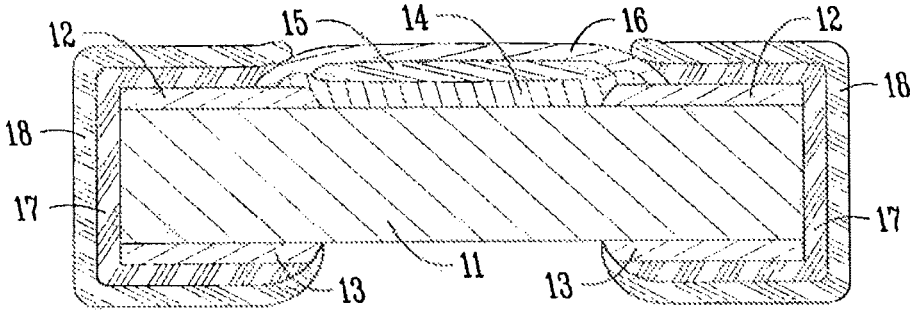
FIG. 1 is a substantially enlarged cross-sectional view of an apparatus according to one aspect of the present invention.

The present invention relates to a chip resistor (FIG. 1) that comprises an insulating substrate 11, top terminal electrodes 12 formed on top surface of the substrate using silver-based cermet, bottom electrodes 13, resistive element 14 that is situated between the top terminal electrodes 12 and overlaps them partially, optional internal protective coating 15 that covers resistive element 14 completely or partially, external protective coating 16 that covers completely the internal protection coating 15 and partially covers top terminal electrodes 12, plated layer of nickel 17 that covers face sides of the substrate, top 12 and bottom 13 electrodes, and overlaps partially external protective coating 16, finishing plated layer 18 that covers nickel layer 17.

The overlap of nickel layer 17 and external protective layer 16 possesses a sealing property because of making the edges of external protective layer 16 platable prior to nickel plating process. Thus, silver terminal electrodes are sealed without use of dedicated protective layers. The silver terminal electrodes are sealed by imparting a protective function to the nickel plating layer that is commonly used as diffusion and leaching barrier between the silver electrodes and the finishing metallization layer (commonly, the tin layer) in terminals of standard (non-sulfur proof) chip resistors.

Possible ways to make dielectric material like protective layer 16 platable include, without limitation, activating it for example by application of conductive material (metal sputtering, chemical deposition of metal, etc.) or by changing its structure (carbonization of polymers by heating, etc.).

Figure 4:
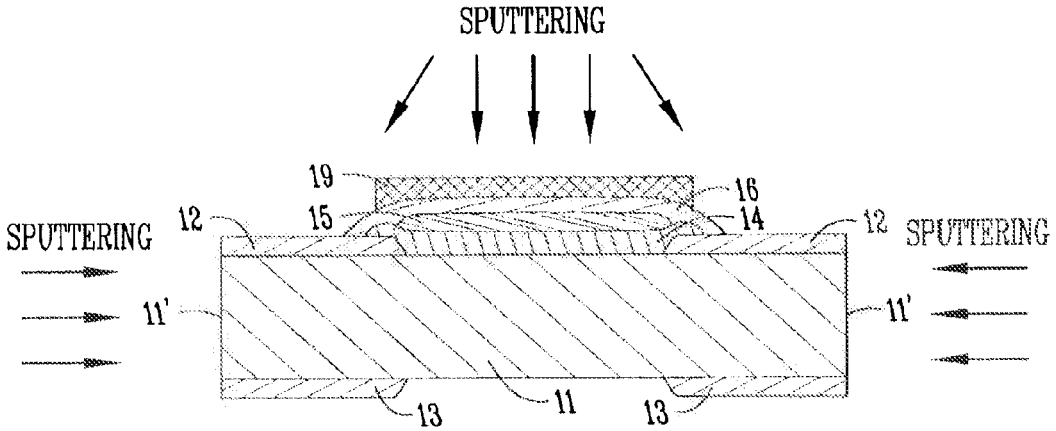
FIG. 4 is a cross-sectional diagram and illustration of a method of making the resistor of FIG. 1 according to an aspect of the present invention.

FIG. 4 shows a process where metal sputtering is used for activation of the edges of the external protective coating 16. An appropriate metal (for example, nichrome alloy) is sputtered on external protective coating 16 making its edges not covered by mask 19 platable. During the following plating process the sputtered metallization layer promotes nickel to plate not only silver terminals 12, 13, and face surfaces 11' of the substrate 11 but to extend to the edges of external protective coating 16 sealing the underlying silver electrodes 12. A good adhesion between nickel layer and metallized edges of external protective coating 16 insures good sealing of silver electrodes 12.

Figure 5:
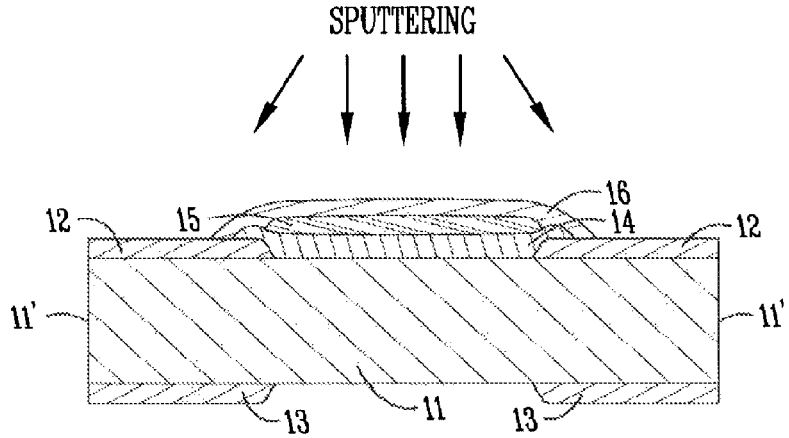
FIG. 5 is a cross-sectional diagram and illustration of a method of making a resistor using a metallization process using low intensity sputtering (without masking).

FIG. 5 shows a second implementation of sputtering process. Sputtering is performed from the top side of chip resistor without masking of the external protective coating 16 but with extremely low intensity of sputtering. Resulting poor metallization facilitates plating of the external protective coating edge but very soon degrades in plating bath because of mechanical abrasion. Therefore, solid metallization of entire top surface does not form.

Figure 6:
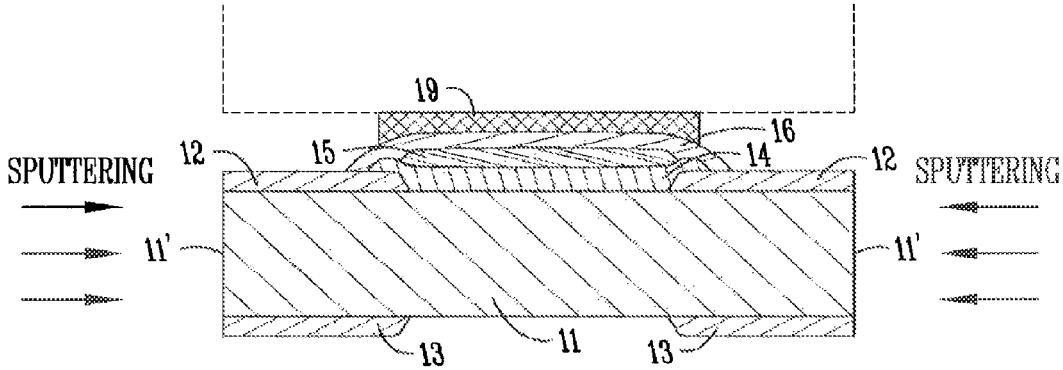
FIG. 6 is a cross-sectional diagram and illustration of a method of making a resistor using very high intensity sputtering (with or without masking).

FIG. 6 shows a third implementation of sputtering process. Sputtering is performed from face sides of stacked chips with or without masking of external protective coating 16 with very high intensity of sputtering sufficient to penetrate into the gap between the adjacent stacked chips and insure metallization of extreme portions of top side of chip. The gap between stacked chips exists because the middle portion of chip covered by external protective coating 16 is thicker than terminal area.

Figure 2:
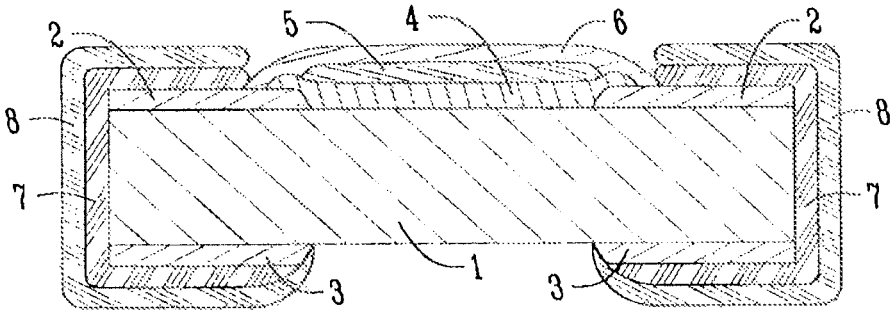
Fig. 2 PRIOR ART
FIG. 2 is a substantially enlarged cross-sectional view of a prior art (non sulfuration resistant) resistor.
Figure 3:
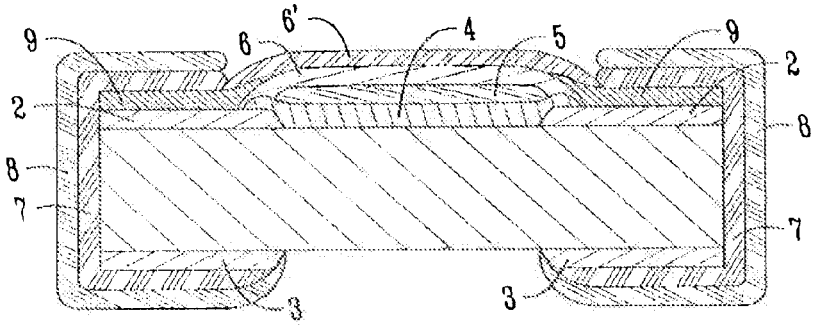
Fig. 3 PRIOR ART
FIG. 3 is similar to FIG. 2 but illustrates a prior art sulfuration resistant resistor.

In the prior art (FIG. 2 and FIG. 3) nickel layer 7 cannot act as a silver protection element because of the poor adhesion of plated nickel layer 7 to the edge of protective coatings 6 (FIG. 2) and 6' (FIG. 3).

In order to protect the sulfuration-susceptible electrodes the present invention provides for imparting the function of protective layer to the plated nickel layer that is commonly used as diffusion and leaching barrier between silver electrodes and finishing metallization layer (tin layer) in terminals of standard (non-sulfur proof chip resistor). For this purpose an appropriate metal (for example nichrome alloy) is deposed on the edges of external protective coating (that are adjacent to silver electrodes) making these edges platable. It promotes nickel to plate not only silver electrodes but to extend to the edges of external protective coating sealing the underlying silver electrodes.

Advantages of this approach include that no additional protective layer is needed. Therefore, thickness of chip resistor is the same as thickness of standard (non-sulfur proof) chip resistor. In addition, the configuration is applicable to all sizes of chips including the smallest ones as there need not be an additional protective layer. In addition, the terminals maintain good platability.

Manufacturing Process

Figure 7:
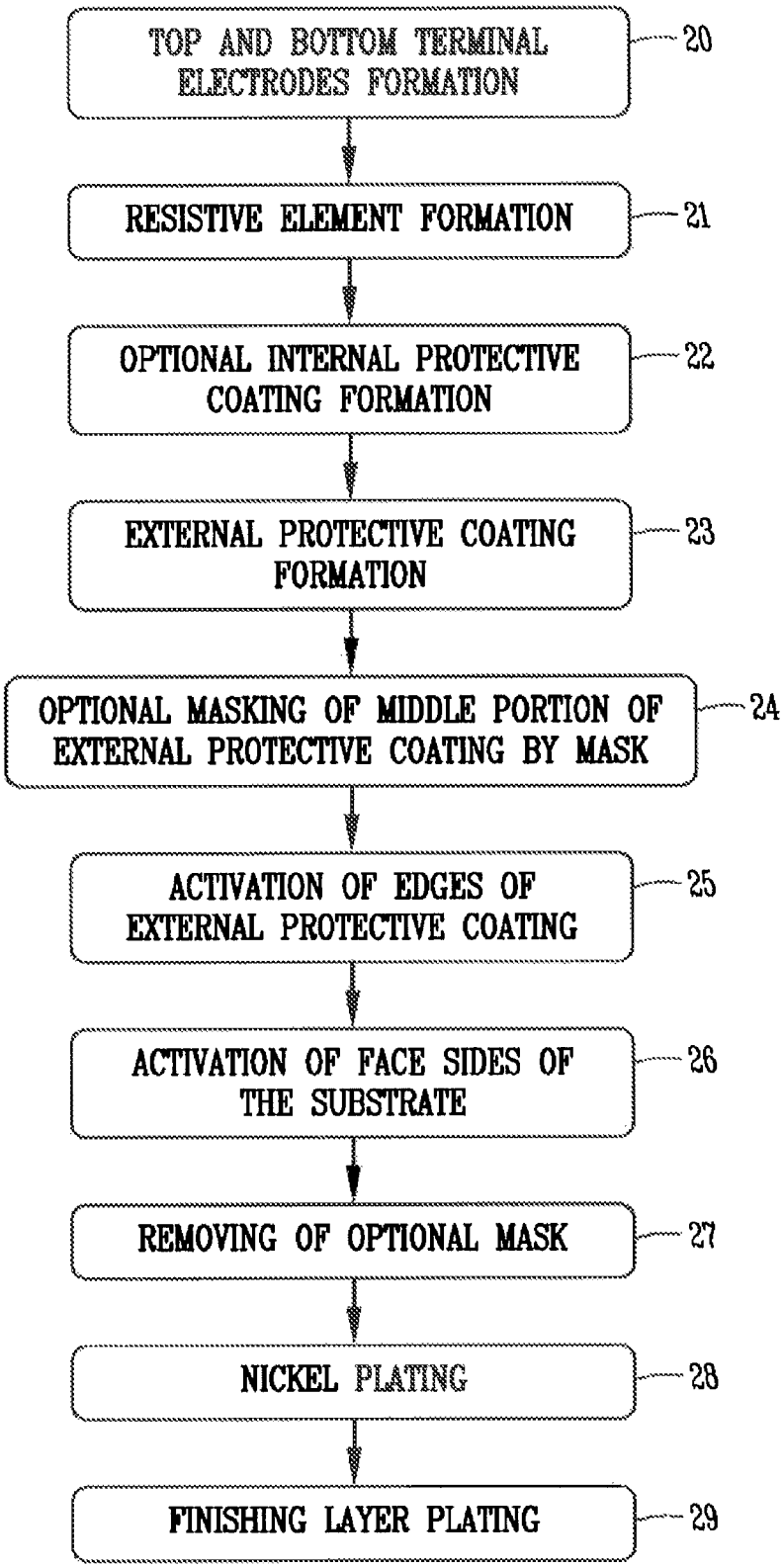
FIG. 7 is a flow diagram illustrating one embodiment of a manufacturing process of the present invention.

The present invention also relates to the method of making the chip resistor. FIG. 7 illustrates one embodiment of a manufacturing process of the present invention. In step 20, the top 12 and bottom 13 terminal electrodes formation is performed. Next, in step 21, resistive element 14 formation is performed. Next, in step 22, an optional internal protective coating 15 formation may be performed. Of course, this step is optional and not required. Next, in step 23, external protective coating 16 formation is performed. In step 24, an optional masking of middle portion of external protective coating by mask 19 may be performed. In step 25, activation of the edges of external protective coating 16 (for example by metal sputtering as shown in FIGS. 4-6) is performed. In step 26, activation of face sides 11' of the substrate 11 (for example, by metal sputtering or by conductive ink application) is performed. In step 27, removal of the optional mask is performed where the optional mask was used. In step 28, plating is performed (preferably using nickel or a nickel alloy). In step 29, the layer plating is finished. Although presented in one order, the sequence of steps maybe altered as appropriate. For example, the sequence of top 12, bottom 13 terminal electrodes, and resistor 14 formation may be altered if necessary.

Step 25 imparts the withstand ability of chip resistor to sulfur containing ambient environment by sealing the sulfuration susceptible terminals. Thus, a method and apparatus for a sulfuration resistant chip resistor has been disclosed. The present invention contemplates numerous variations, including variations in the type of materials, the sequence of steps, whether optional steps are performed or not, and other variations, alternatives, and options within the spirit and scope of the invention.

What is claimed is:

1. A chip resistor comprising:

sulfuration-susceptible upper terminal electrodes on opposite sides of a resistive element formed on a side of an insulating substrate;

an external non-conductive protective coating overlaying a least a portion of the resistive element, edges of the external non-conductive protective coating made platable by a pre-applied metallization layer;

a uniform conducting metal plated layer covering opposite face sides of the insulating substrate, the upper sulfuration-susceptible terminal electrodes and edges of the external non-conductive protective coating, and adhered to the edges of the external non-conductive protective coating made platable by a pre-applied metallization layer.

2. The chip resistor of claim 1, wherein the pre-applied metallization layer is applied by metallization of face sides of the insulating substrate and edges of the external non-conductive protective coating.

3. The chip resistor of claim 1, wherein the pre-applied metallization layer is formed by sputtering.

4. The chip resistor of claim 1, further comprising a second metal plated layer over the first metal plated layer.

5. The chip resistor of claim 1 further comprising overlapping the metal plated layer over a portion of the adjacent edges of the external non-conductive protective coating.

6. The chip resistor of claim 1, wherein the chip resists sulfuration phenomenon relative to the terminal electrodes.

7. The chip resistor of claim 1 wherein the chip resistor is one of a thick film chip resistor or a thin film resistor.

8. A method of deterring sulfuration in a chip resistor comprising upper sulfuration-susceptible terminal electrodes on opposite sides of a resistive element disposed on a side of an insulating substrate, an external non-conductive protective coating overlaying at least a portion of the resistive element, and a uniform conducting metal plated layer covering opposite face sides of the insulating substrate and in contact with exposed portions of the upper sulfuration-susceptible terminal electrodes, the method comprising:

sealing the upper sulfuration-susceptible terminal electrodes from the external environment;

wherein the step of sealing the upper sulfuration-susceptible terminal electrodes comprises overlapping the metal plated layer over exposed portions of the upper sulfuration-susceptible terminal electrodes and over adjacent edges of the external non-conductive protective coating;

wherein the step of sealing the upper sulfuration-susceptible terminal electrodes further comprises forming metalized edges of the external non-conductive protective coating prior to application of the metal plated layer; and wherein the metal plated layer is adhered to the metalized edges of the external non-conductive protective coating.

9. The method of claim 8, wherein the metalized edges are formed by sputtering.

10. The method of claim 8, wherein the metal plated layer is formed by sputtering.

11. The method of claim 8, further comprising forming a finishing plated layer over the metal plated layer.

* * * * *